United States Patent [19]

McKinney

[11] 4,090,611

[45] May 23, 1978

[54] METHOD AND APPARATUS FOR SORTING DOCUMENTS

[75] Inventor: Gordon W. McKinney, Souderton, Pa.

[73] Assignee: Pheripheral Sciences, Inc., Norristown, Pa.

[21] Appl. No.: 731,802

[22] Filed: Oct. 12, 1976

Related U.S. Application Data

[63] Continuation of Ser. No. 575,071, May 6, 1975, abandoned.

[51] Int. Cl.[2] ..... B07C 5/344

[52] U.S. Cl. ..... 209/111.8; 209/81

[58] Field of Search ..... 209/111.8, DIG. 1, 74 M; 235/61.12 M, 61.12 R, 61.12 N; 214/11 R, 11 M; 53/50

[56] References Cited

U.S. PATENT DOCUMENTS

| | | | |
|---|---|---|---|
| 3,609,694 | 9/1971 | Brenner | 209/DIG. 1 |
| 3,895,220 | 7/1975 | Nelson et al. | 209/74 |

*Primary Examiner*—Allen N. Knowles

[57] ABSTRACT

Method and apparatus for separating bundles of envelopes containing information-bearing documents according to preselected sorting scheme. Documents are marked with iron particle deposits, in coded format, prior to being placed in the envelopes. The locations of the deposits correspond to the information of interest. After the marked documents are sealed in envelopes the locations of the iron particle deposits are sensed to control sorting apparatus for separating the documents according to the sensed information.

5 Claims, 5 Drawing Figures

METHOD AND APPARATUS FOR SORTING DOCUMENTS

This is a continuation, of application Ser. No. 575,071 filed May 6, 1975, now abandoned.

The present invention relates, in general, to the sorting of documents containing different information and, in particular, to a method and apparatus for separating bundles of mail according to the zip codes of the addressees of the mail.

Various techniques and systems currently are available for sorting, in a preselected manner, documents, such as data processing cards, which bear information. Generally, equipment of this type includes means for "reading" the particular information from the documents and means for controlling the movement of the documents to particular locations in accordance with the information read from the documents. The information may be stored in the documents in a number of different ways. Two rather common approaches are punched holes and magnetized ink. By optically sensing the presence or absence of punched holes in coded format or by electronically sensing the presence or absence of magnetized ink spots in coded format, the documents are "read" and control signals are developed by the sensing apparatus to control electromechanical devices which segregate the different documents according to the sensed information.

The United States Postal Service faces one of the greatest sorting problems known. One can readily appreciate the problem by considering the amount of daily mail and the many different locations to which a given bundle of mail from a single sender may be directed. To some extent the problem is alleviated through the use of zip codes. However, even with zip codes it is still necessary to sort the mail.

The task of sorting mail according to zip codes may be handled either by the Postal Service or the sender. One approach for automatically sorting mail involves the use of optical scanning devices which actually read the zip code numerals on the face of the envelope. Optical scanning units, however, are quite expensive.

The present invention offers an efficient and practical solution to a major portion of the problem faced by the Postal Services of the United States and other countries. While the method and apparatus of the present invention will be described as having particular application in the sorting of mail according to zip codes, it will be apparent that the underlying concept of the invention may be extended to other uses.

Accordingly, it is an object of the present invention to provide a new and improved method and apparatus for sorting information-bearing documents.

It is another object of the present invention to provide such a method and apparatus which are relatively simple in concept and implementation, yet highly efficient when put to use.

It is a further object of the present invention to provide a method and apparatus for sorting information-bearing documents which are relatively inexpensive to utilize.

In accordance with the present invention, a bundle of information-bearing documents, sealed in envelopes, is sorted in a predetermined manner, by first reading a storage medium to extract particular information of interest and then magnetically marking the documents in accordance with the sensed information. After the documents are placed in the envelopes and the envelopes are sealed, the magnetic markings are read and the envelopes are sorted accordingly.

For a better understanding of the present invention, together with other and further objects thereof, reference is made to the following description, taken in connection with the accompanying drawing, and its scope will be pointed out in the appended claims.

Referring to the drawing.

Figure 1:
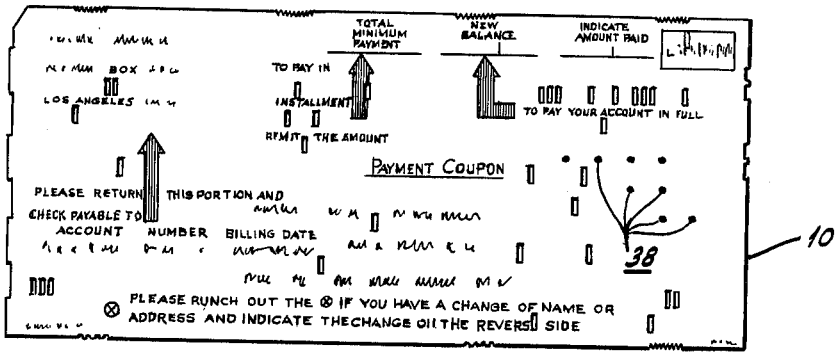
FIG. 1 is a plan view showing a typical data processing card having holes punched in a coded format.

The data processing card 10, shown in FIG. 1, contains various pieces of information in coded, punched format. This card may correspond to the one mailed by a gasoline company or a telephone company to a customer. The punched information may include, among other items, the charge to the customer, the account number and the customer's address, including the zip code. The code employed in punching the information may be any of the ones currently in use, such as the binary code.

Figure 2:
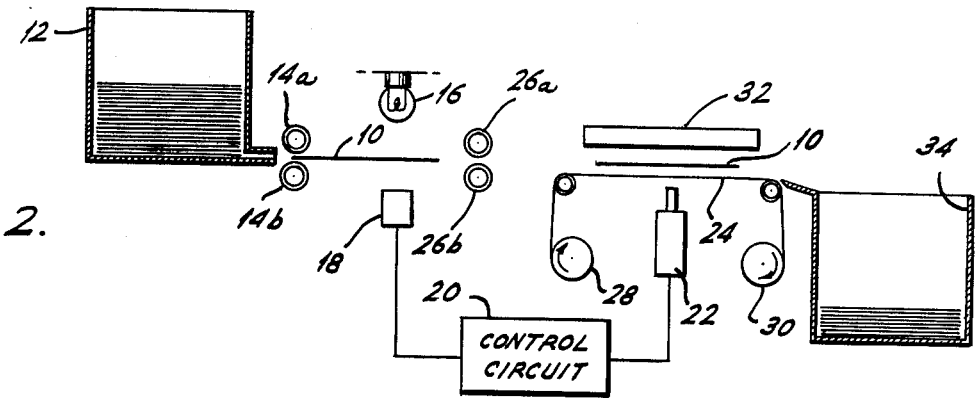
FIG. 2 is a schematic drawing showing a portion of the apparatus of the present invention.
Figure 3:
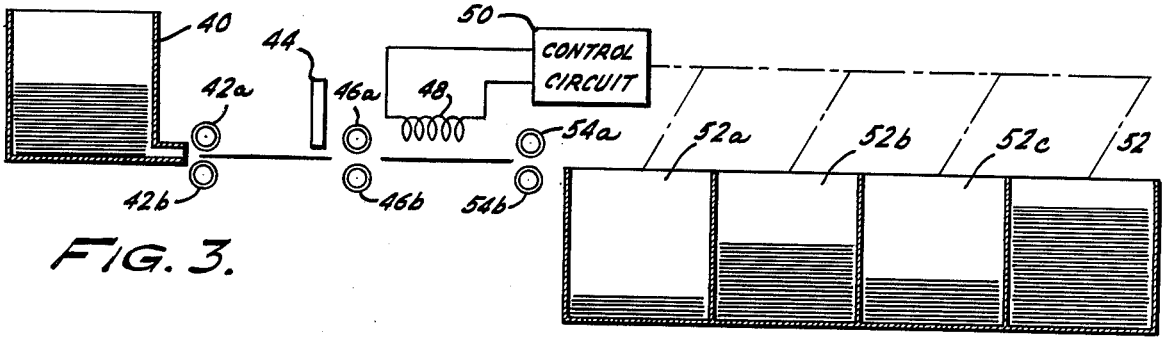
FIG. 3 is a schematic drawing showing another portion of the apparatus of the present invention.

After the various pieces of information have been punched into card 10, but before the card is sealed in an envelope, the card is processed by the apparatus shown in FIG. 2. It should be understood that FIGS. 2 and 3 are intended to be simplified schematic drawings representative of the equipment being described and are not intended to illustrate completely all details of the component parts. It will be obvious to one skilled in the art that the various components included in the apparatus are conventional, commercially available parts. A stack of cards, each containing different information of the same nature, is placed in an output hopper 12. The cards are removed individually from input hopper 12 and are transported by a pair of rollers **14*a* and 14*b* to a reading station comprising light source 16 and sensor 18. The presence of a punched hole is sensed by light from source 16 passing through the hole in the card and being picked up by sensor 18. A separate light sensor is provided for each row of information on the card being read with the total number of rows corresponding to the number of bits in the particular code being used. When using a Hollerith code, twelve sensors 18** are used to sense information contained in the twelve rows of the card. A single elongated light source may be used for a plurality of rows or individual light sources, paired with individual light sensors, may be used.

The light sensors 18 develop signals representative of the information read from the card and these signals are supplied to control circuit 20 which controls the marking apparatus. Also, conventional circuitry is included to provide position signals which indicate the particular column from which data is being sensed by sensors 18. The control circuitry operates one or more solenoids 22 which, when actuated, cause a ribbon 24, containing iron particles and a suitable adhesive, to contact the card which has been moved from the reading station to the marking station by a pair of rollers **26*a* and 26*b*. The number of solenoids 22 again is dependent upon the encoding scheme for the information in question. The control circuit 20, having an appropriate delay built in to compensate for the time required for the card to advance to the marking station, controls the solenoids individually in accordance with the outputs of the corresponding light sensors. It will be understood that appropriate components will be included to sense the card leaving the reading station and arriving at the marking station, whereby the actuation of the solenoids is properly synchronized. Ribbon 22 moves from a supply reel 28 to a take-up reel 30 in much the same way as a typewriter ribbon advances in use. A back-up plate 32 is provided to support the engagement of the card by the solenoids. After the cards have been thus marked, they are collected in an output hopper 34**.

The iron particles are spotted on the card in coded format. When the same coding is used as was used to punch the holes, the iron particles pattern will be similar to the punched holes. Preferably, a more simple coding scheme is employed if the application permits. In the case of sorting according to zip codes, a four bit binary code may be used. The iron particles may be deposited at any suitable location on the card, for example between the punched columns, as illustrated by the black marks 38 in FIG. 1. Reading from left to right, the pattern of black marks corresponds to the 11374 zip code.

The stack of cards is removed from hopper 34 and the cards are placed individually into envelopes which then are sealed. The envelopes may be preaddressed or addressed subsequent to loading and sealing. The loading and sealing of the envelopes may be manual or by machine.

Referring to FIG. 3, the stack of envelopes, containing cards having iron particles deposited in coded format, is placed in an input hopper 40. The envelopes are removed individually from hopper 40 and are transported by a pair of rollers 42*a* and 42*b* past a magnet 44 and by another pair of rollers 46*a* and 46*b* to a reading station comprising one or more sensing coils 48. Magnet 44 magnetizes the iron particles deposited on the cards within the envelopes. After the particles have been magnetized, the cards pass the sensing coils which are arranged to sense the presence of iron particle deposits and develop signals representative of the information being read from within the sealed envelope. These signals are supplied to a control circuit 50 which controls which hopper of the plurality of hoppers 52*a*, 52*b*, 52*c* and 52*d* will receive any given envelope. In particular, after the card within the envelope has been read, it is moved by a pair of rollers 54*a* and 54*b* to hoppers 52*a*, 52*b*, 52*c* and 52*d*. The number of hoppers required is dependent upon the selected sorting scheme. Control circuit 50 controls access to the various hoppers in accordance with the information read by the sensing coils 48. The dot-dash lines represent an electromechanical control of the sorting of the envelopes in the different hoppers according to the information within the envelopes.

Figure 4:
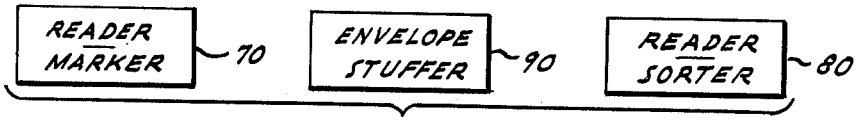
FIG. 4 is a block diagram of a system embodying the present invention.

FIG. 4 shows a system embodying the present invention. The READER-MARKER 70 corresponds to the apparatus shown in FIG. 2, while the READER-SORTER 80 corresponds to the apparatus shown in FIG. 3. The ENVELOPE STUFFER 90 may be any of the systems currently available which automatically load documents into envelopes and seal the envelopes.

In operation, the punched cards are read and marked magnetically by the READER-MARKER 70. The cards so marked may be manually loaded into the ENVELOPE STUFFER 90 where the cards are individually stuffed into envelopes and the envelopes are sealed. The sealed envelopes, in turn, may be manually loaded into the READER-SORTER 80 where the envelopes are sorted according to the zip codes read from the magnetic markings on the cards enclosed within the sealed envelopes. While manual loading into the ENVELOPE STUFFER 90 and READER-SORTER 80 is contemplated, a fully automatic system may be developed if the application justifies the expense.

Figure 5:
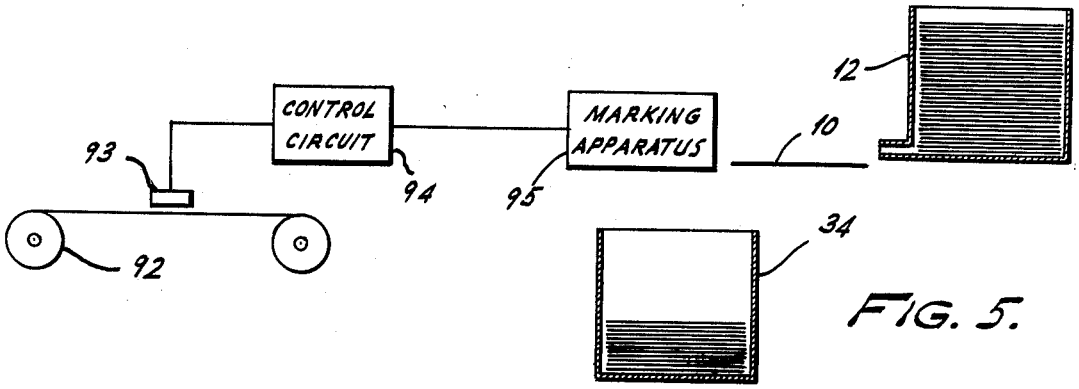
FIG. 5 is a schematic drawing showing a modification to the apparatus of FIG. 2.

It should also be pointed out that since the information printed on and punched into a card generally is supplied from a magnetic storage, the iron particles zip code information or any other information of interest may be applied to the card in response to being read from the magnetic storage. Thus, if zip code information or any other information of interest is not normally punched into the data processing card, it is not necessary to do so merely to provide a basis for subsequent development of the iron particle deposits. In such a case, the READER-MARKER apparatus of FIG. 2 would include conventional tape reading apparatus, rather than the illustrated optical sensing components. This is illustrated in FIG. 5. A reel of magnetic tape 92 is sensed by a magnetic head unit 93 which develops signals representative of the sensed information which may correspond to zip codes. These signals are supplied to a control circuit 94 which operates to control the iron particle marking apparatus 95 which is similar to that shown in FIG. 1. A series of data processing cards 10 are supplied from the input hopper 12 to the marking apparatus synchronized to be marked in accordance with the information read from the magnetic tape. After the cards are marked they are supplied to the output hopper 34.

While in the foregoing there have been disclosed preferred embodiments of the invention, it will be obvious to one skilled in the art that various modifications may be made which are within the intended scope of the invention as recited on the appended claims.

What is claimed is:

1. Apparatus for sorting a bundle of envelopes according to particular information contained in documents within said envelopes, said apparatus comprising:

means for sensing a storage medium to extract said particular information;

means responsive to said sensing means for depositing iron particles on said documents in discrete locations corresponding to a coded format of said sensed information;

means for depositing said documents individually in envelopes;

means for magnetically sensing said documents to extract said particular information;

and means responsive to said magnetic sensing means for sorting said envelopes in accordance with a predetermined pattern.

2. Apparatus according to claim 1 wherein said storage medium is a stack of punched data processing cards and said first sensing means is an optical card reader.

3. Apparatus according to claim 1 wherein said storage medium is a magnetic storage and said first sensing means is a magnetic head reader.

4. Apparatus according to claim 1 wherein said documents are punched data processing cards.

5. Apparatus according to claim 4 wherein said particular information corresponds to zip codes.

* * * * *